US012221742B2

(12) United States Patent
Nilsson et al.

(10) Patent No.: US 12,221,742 B2
(45) Date of Patent: Feb. 11, 2025

(54) TUMBLE DRYER

(71) Applicant: Electrolux Professional AB, Stockholm (SE)

(72) Inventors: Martin Nilsson, Stockholm (SE); Gunnar Ingemar Persson, Stockholm (SE)

(73) Assignee: Electrolux Professional AB, Stockholm (SE)

( * ) Notice: Subject to any disclaimer, the term of this patent is extended or adjusted under 35 U.S.C. 154(b) by 851 days.

(21) Appl. No.: 17/059,554

(22) PCT Filed: Jun. 4, 2018

(86) PCT No.: PCT/EP2018/064652
§ 371 (c)(1),
(2) Date: Nov. 30, 2020

(87) PCT Pub. No.: WO2019/233548
PCT Pub. Date: Dec. 12, 2019

(65) Prior Publication Data

US 2021/0207314 A1 Jul. 8, 2021

(51) Int. Cl.
*D06F 58/02* (2006.01)
*D06F 58/20* (2006.01)
*D06F 58/22* (2006.01)

(52) U.S. Cl.
CPC ..... *D06F 58/02* (2013.01); *D06F 58/20* (2013.01); *D06F 58/22* (2013.01)

(58) Field of Classification Search
CPC ..... D06F 58/02; D06F 58/20; D06F 58/206; D06F 58/22
See application file for complete search history.

(56) References Cited

U.S. PATENT DOCUMENTS

2005/0102852 A1* 5/2005 Mizhari ..... D06F 58/203 34/130
2013/0125410 A1 5/2013 Gregory
2016/0115637 A1* 4/2016 Yu ..... D06F 58/20 34/601

FOREIGN PATENT DOCUMENTS

DE 4212700 10/1993
DE 112013003918 5/2015
(Continued)

OTHER PUBLICATIONS

Translation, EP-0103228-A2 (Year: 1984).*
International Search Report and Written Opinion for PCT/EP2018/064652 dated Dec. 10, 2018, 9 pages.

*Primary Examiner* — Jessica Yuen
(74) *Attorney, Agent, or Firm* — Pearne & Gordon LLP

(57) ABSTRACT

A tumble dryer (1) comprising: a rotatable drying drum (21), adapted to receive laundry to be dried, said drum (21) comprising a cylindric outer periphery (27) provided with a plurality of openings (25); at least one particle separation filter (29) arranged below the drying drum (21), said filter (29) having a width corresponding to at least 50% of the cylindrical diameter of the drum (21); a fan (39) and a funnel shaped interface (45) adapted for formation of a tapering transmission channel between the at least one filter (29) and the fan (39). The fan (39) being a radial fan, having an axis (47) arranged with an inclination ($\alpha$) of 0-25° from a vertical direction (V), such that an air stream that is introduced into the drum (21) leaves the drum (21) through the periphery (27) thereof, is led through the at least one filter (29), is collected by the funnel shaped interface (45), and directed towards a rear part of the tumble dryer (1) by the fan (39).

13 Claims, 3 Drawing Sheets

(56) References Cited

FOREIGN PATENT DOCUMENTS

| | | | | | |
|---|---|---|---|---|---|
| EP | 0103228 | A2 * | 3/1984 | | |
| EP | 2527524 | A1 * | 11/2012 | ..... | D06F 58/20 |
| EP | 2987904 | | 2/2016 | | |
| EP | 3118365 | | 1/2017 | | |
| JP | H03 18399 | | 1/1991 | | |
| KR | 20140124629 | | 10/2014 | | |

* cited by examiner

TUMBLE DRYER

FIELD OF THE INVENTION

The present invention relates to a tumble dryer.

BACKGROUND OF THE INVENTION

In tumble dryers, hot air is used to dry wet laundry. There are three different principles for tumble dryers: exhaust air dryer, condensing dryer, and heat pump dryer.

An exhaust air dryer is connected to the ventilation system within the building and the wet humidified air used to dry laundry is released to this ventilation system.

In the condensing dryer water is condensed from the humidified air before the hot air is released to the environment around the tumble dryer. The condensed water is collected in a drain tank or is released to a drainage within the building.

A heat pump dryer recirculates the humidified air from the drum to an evaporator where the humidified air is cooled and dehumidified by heat exchange. The dehumidified air is heated by heat exchanged in a condenser, subsequently, the heated and dry air is supplied into the drum for performing the laundry drying process. As a result, dry warm air is repeatedly supplied into the drum, whereby laundry is dried. This type of dryer is the most environmentally friendly since the laundry can be dried at a lower temperature, resulting in lower energy consumption.

Common to all types of tumble dryers is the limited space for accommodating all components, which are required for the drying process, especially for small tumble dryers with a capacity to dry up to 7-8 kg of wet laundry.

SUMMARY OF THE INVENTION

It is an object of the present invention to obtain a tumble dryer with a capacity to dry up to 7-8 kg of wet laundry, which has an improved performance compared to known tumble dryers.

This is at least partly achieved by means of a tumble dryer comprising a rotatable drying drum, adapted to receive laundry to be dried, the drum comprising a cylindric outer periphery provided with a plurality of openings; at least one particle separation filter arranged below the drying drum, said filter having a width corresponding to at least 50% of the cylindrical diameter of the drum; a fan and a funnel shaped interface adapted for formation of a tapering transmission channel between the at least one filter and the fan. The fan is a radial fan, having a rotation axis arranged with an inclination of 0-25° from a vertical direction, such that an air stream that is introduced into the drum leaves the drum through the periphery thereof, is led through the at least one filter, is collected by the funnel shaped interface, and directed towards a rear part of the tumble dryer by the fan.

Through this embodiment, it is possible circulate a larger amount of air inside the machine while maintaining a compact construction. By changing the flow direction of the airflow by the fan, it is possible to direct the airflow in a direction which is best suited given the space within the tumble dryer. The humidified air from the tumble dryer enters the fan in a vertical direction, is converted by the fan to an almost horizontal direction that is directed towards the rear part of the tumble dryer.

The axis of the fan may be arranged with an inclination of 5-15° from a vertical direction.

To accommodate additional components, for example an air heat pump system near the fan, the air flow from the fan may be directed towards a rear part of the tumble dryer. By inclining the axis of the fan 5-15° from a vertical position, the space within the tumble dryer is used in an advantageous manner. It has been found that an inclination of axis of the fan of about 7° from a vertical position may provide the best position for other components.

The fan may comprise a motor, and the fan and the motor may be surrounded by a plastic shell comprising the funnel shaped interface, forming a fan arrangement.

To protect the fan and to be able to collect a large air flow from the drum and the particle filter into the fan, a plastic shell may be arranged around the fan and the motor that powers the fan. The funnel shaped interface may form an integral part of the plastic shell and may have the shape of a rectangle that corresponds to the size of the particle filter.

The fan arrangement may be, separably attached to the tumble dryer and removable without tools as one unit through a front side of the tumble dryer.

The tumble dryer may be provided with a hatch in the front wall of the tumble dryer below the drum. The fan arrangement may be pulled out from the tumble dryer as one unit without using any tools, which facilitates service, repairs or replacement of the fan and/or its motor.

The fan arrangement may be attached to the tumble dryer through a stiff connection. It may be insertable in grooves arranged in respective sidewalls of the tumble dryer and may be held in place by the hatch in the front wall of the tumble dryer.

The funnel-shaped interface of the fan arrangement may be inserted in the grooves, which provides a stiff connection and prevents the interface from bending in the middle. This provides is simple, cheap, and reliable solution to keep the fan arrangement in place within the tumble dryer, and at the same time facilitating withdrawal of the fan arrangement from the tumble dryer.

The fan arrangement may rest against a bottom wall, inside the tumble dryer.

By arranging one side of the fan arrangement suspended in the grooves within respective sidewalls of the tumble dryer and the opposite side resting on the bottom side of the tumble dryer, the fan arrangement may be reliably positioned in the tumble dryer.

The tumble dryer may further comprise a heat pump system. The heat pump system may comprise an evaporator, a compressor, a condenser, and an expansion valve, wherein the fan arrangement is arranged upstream the evaporator.

By arranging a heat pump system downstream of the fan arrangement, the air stream may be circulated within the tumble dryer, the drying time in the drum may be shorter, the tumble dryer may have higher performance, which results in energy savings. The evaporator may be placed within the tumble dryer with a free space underneath for drainage of the condense water produced in the evaporator. With a low position of the fan arrangement it is advantageous to incline the fan and fan arrangement to direct the air stream slightly upwards, towards the evaporator.

The heat pump system and the fan arrangement may be arranged in a L-shape behind the drum, along the rear part of tumble dryer and below the drum.

By arranging the heat pump system and the fan arrangement in an L-shape within the tumble dryer, the space within the tumble dryer is used efficiently and gives a compact dryer with high performance.

The at least one particle separation filter may have a width corresponding to 80-100% of the cylindrical diameter of the drum.

The entire air stream that leaves the drum will pass the particle separation filter(s) for separation of lint and other particles, that leave clothes during the drying process, before the air stream enters the fan arrangement and the heat pump system, which effectively eliminates particles from the air stream and prevents clogging of other components in the dryer. A wide filter provides less resistance to the air stream.

At least one particle separation filter may be a filter adapted to remove 80% or more of particles with sizes down to 4 μm.

By arranging this filter before the fan arrangement and the heat pump system, clogging of e.g. a condenser may be wholly or partly prevented and less maintenance work becomes necessary.

A motor may power the rotation of drum. The motor may be arranged on the top of the drum.

By arranging the motor on top of the drum, the tumble dryer becomes more compact.

It is noted that embodiments of the invention may be embodied by all possible combinations of features recited in the claims.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION OF THE EXEMPLARY EMBODIMENTS

Figure 1:
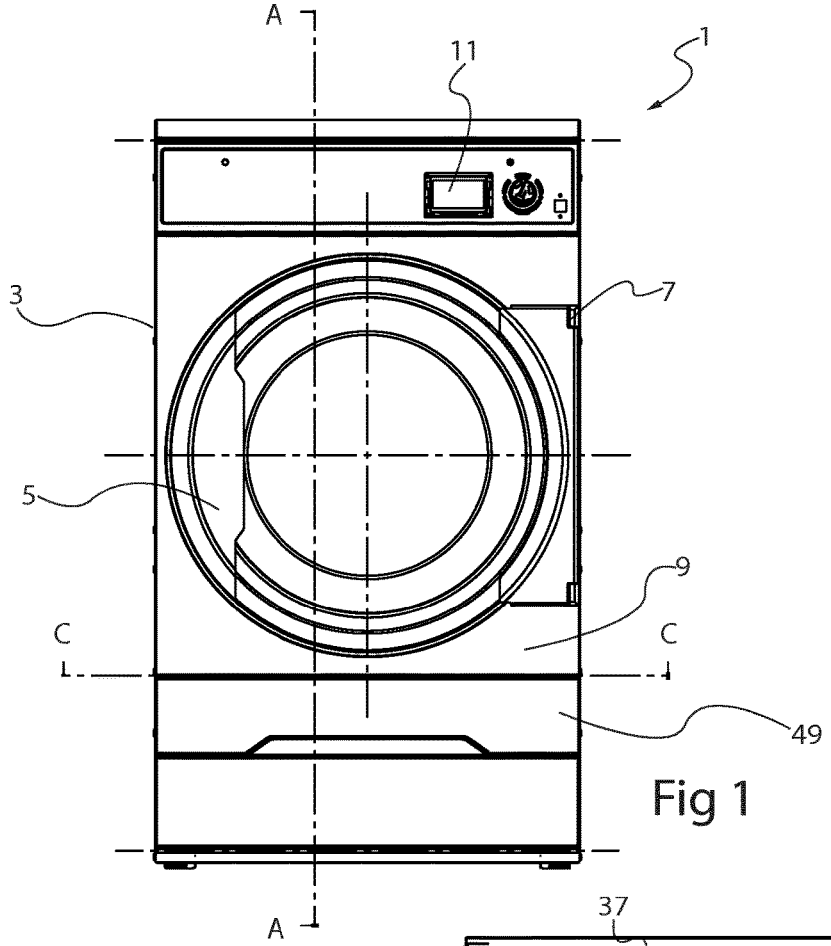
FIG. 1 is a front view of a tumble dryer.

FIG. 1 illustrates schematically a tumble dryer 1 comprising a parallelepiped-shaped casing 3. A door 5 is attached by hinges 7 to a front wall 9 of the casing 3 for input of wet laundry to be dried and for output of dry laundry. The tumble dryer 1 may further comprise an appliance control panel 11 located on the front wall 9 of the casing 3, which allows the user to manually select a desired drying cycle among several available drying cycles.

Figure 2:
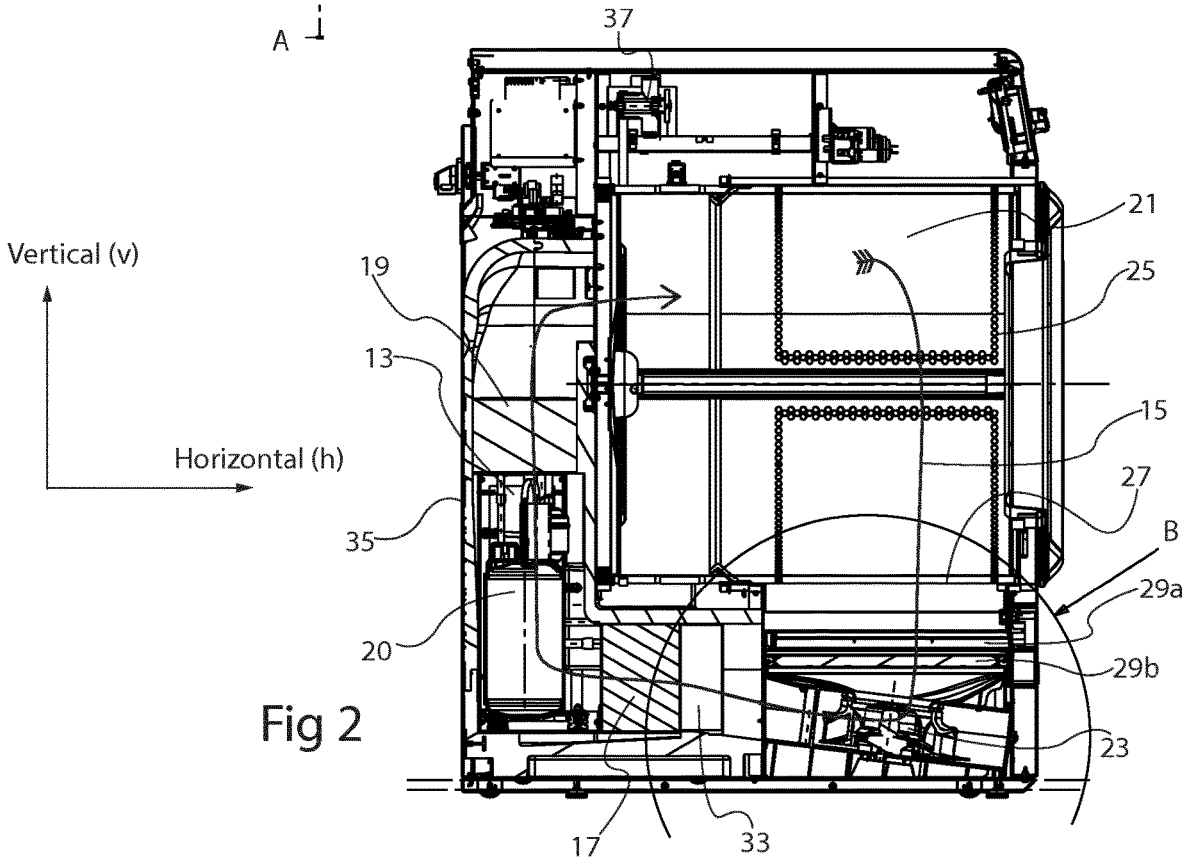
FIG. 2 is a cross section (cf. A-A FIG. 1) side view of a tumble dryer comprising a heat pump system, with interior parts exposed.

FIG. 2 illustrates a cross section view A-A of the tumble dryer in FIG. 1. The tumble dryer 1 comprises a heat pump system 13 and provides an air stream circuit 15 for circulation of an air stream within the tumble dryer 1. The heat pump system 13 may comprise an evaporator 17, a condenser 19 and an expansion valve (not shown).

Wet laundry to be dried is fed into a rotatable drying drum 21 arranged inside the casing 3 through the door 5 arranged at the front wall 9 of the tumble dryer 2. Warm, dry air may be used for removing moisture from the wet laundry while the drum 21 rotates. An air flow stream may be circulated in an air stream circuit 15, moved by a fan arrangement 23. In the shown embodiment, the fan arrangement 23 is situated below the drying drum 21 but before the evaporator 17. The fan arrangement 23 could alternatively be located in the loop between condenser 19 and the drying drum 21. Due to space considerations in the shown embodiment, the location of the fan arrangement 23 below the drying drum 21 has been selected.

When the wet laundry is dried in the drying drum 23, moisture is transferred from the wet laundry to the air stream that is circulated in the drying drum 23. The warm, humidified air leaves the drying drum 23 through a plurality of openings 25 in a cylindric outer periphery 27 thereof and is circulated to the fan arrangement 23.

The air flow stream may be passed through at least one filter 29 for separation of particles or lint from the air flow stream before it enters the fan arrangement 23. In the illustrated embodiment in FIG. 2, there are two particle separation filters 29*a, b*. One for separation of lint 29*a*, which is formed when the laundry is dried in the drum 21, and one filter 29*b* adapted to remove 80% or more of particles with sizes down to 4 μm.

Figure 3:
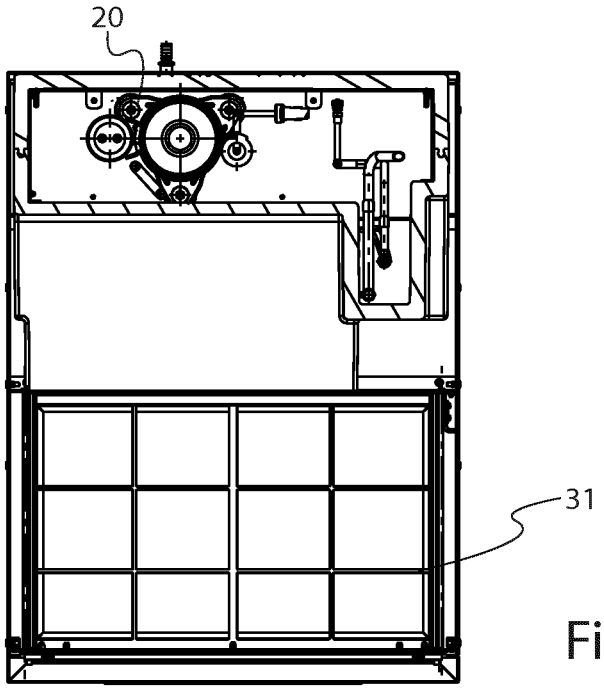
FIG. 3 is a cross section top view (cf. C-C FIG. 1) of a tumble dryer with interior parts exposed.

The filter(-s) 29*a*, 29*b* may have the shape of a rectangle with a width corresponding to 80-100% of the cylindrical diameter of the drum. The filter 29*a*, can be fixed in a plastic frame 31 provided with a grid to provide stability to the filter(-s) and ensure that they remain stretched, as seen in FIG. 3. By arranging these filter(-s) 29*a*, 29*b* before the fan arrangement 23 and the heat pump system 13, clogging of these systems 23, 13 may be prevented and less maintenance work becomes necessary.

The warm, humidified air is passed from the fan arrangement 23 through an air flow duct 33 into the evaporator 17, which is made up of ducts (not shown) where warm, humidified air and a refrigerant are led alternately in the ducts and the air stream is cooled down and dehumidified through heat exchange to the refrigerant. Condensed water can be removed from the condenser by a tube (not shown).

The cooled, dehumidified air is then circulated from the evaporator 17 to the condenser 19, where the air stream is heated again through heat exchange with the refrigerant.

The warm air stream is then blown into the drying drum 21 again. The arrow indicates the circulation of the air stream in the air stream circuit 15.

The refrigerant is lead through a refrigerant circuit, where a compressor 20 compresses the refrigerant, and where the refrigerant is condensed in the condenser 19 and vaporized in the evaporator 17 after passing an expansion valve (not shown).

The heat pump system 13, comprising the evaporator 17, the compressor 20, the condenser 19 and the expansion valve (not shown), may be arranged partly behind the drying drum 21, along the rear side of the tumble dryer 1 and may be enclosed with an insulating shell 35 with openings to let the air stream in and out.

The heat pump system 13 and the fan arrangement 23 may be arranged in an L-shaped configuration behind the drying drum 21, along the rear part of tumble dryer 1 and below the drying drum 21.

The rotation of the drying drum 21 may be powered by a motor 37. As seen in FIG. 2, this motor 37 may be arranged on top of the drying drum 21, providing a compact arrangement.

By arranging the components within the tumble dryer 1 as shown in FIG. 2, the space within the tumble dryer 1 is used efficiently and gives a compact tumble dryer 1 with high performance.

Figure 4:
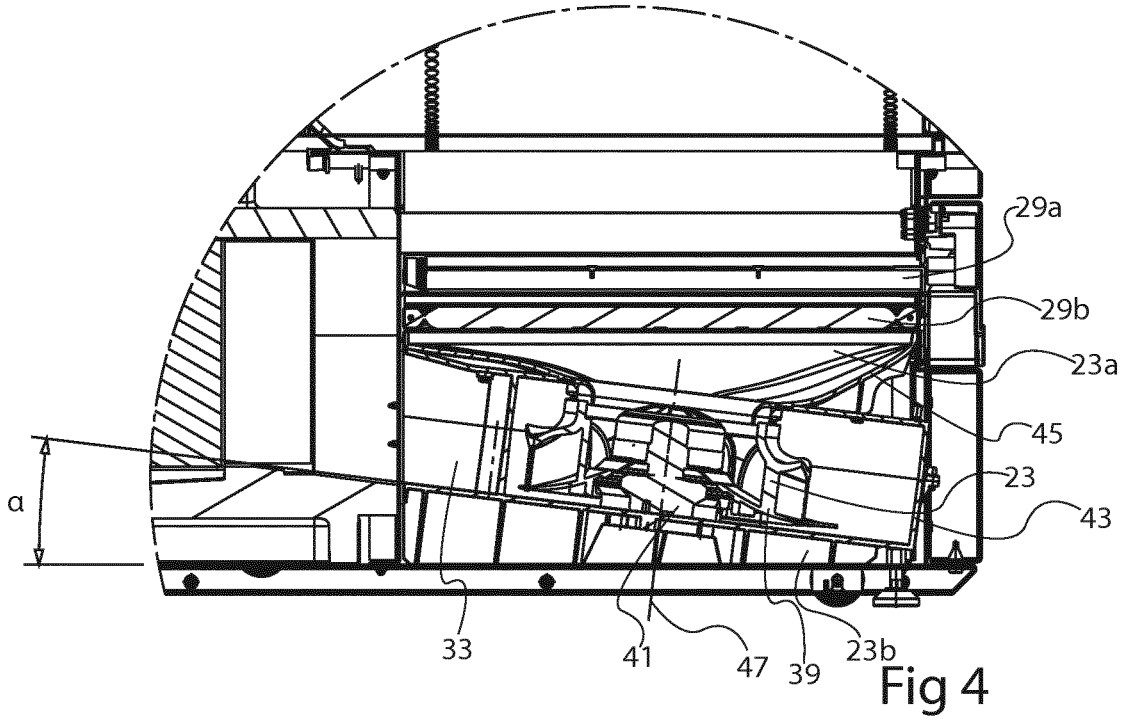
FIG. 4 is an enlarged view of the portion B in FIG. 2.

FIG. 4 shows an enlarged view of the fan arrangement 23. The fan arrangement 23 may comprise a radial fan 39 that is powered by a motor 41, surrounded by a plastic shell 43 comprising a funnel shaped interface 45.

The plastic shell 43 can be assembled by several parts that form one unit with the radial fan 39 and the fan motor 41.

The funnel shaped interface 45 may be an integrated part of the plastic shell 43, can have a rectangular inlet corresponding to the size of the particle filter(s) 29*a*, 29*b* and is adapted to collect a large amount of humidified, warm air from the drying drum 23 and bring this air flow in a vertical direction (V) into the radial fan 39. The flow direction on the air stream is changed by the radial fan 39 so that the airflow leaving the radial fan is directed towards a rear part of tumble dryer 1 via the air flow duct 33 towards the evaporator 17.

By changing the flow direction of the airflow by the fan 39, it is possible to direct the airflow, in a manner best suited given the space within the tumble dryer 1. The humidified air from the tumble dryer 1 enters the fan 39 in a vertical direction (V) and is converted by the fan 39 to an almost horizontal direction (H) that is directed towards the rear part of the tumble dryer 1.

The evaporator 17, located downstream the fan arrangement 23 may require a free space underneath for efficient drainage of the condense water produced in the evaporator 17. The fan arrangement 23 may have lower position than the evaporator 17, since a bottom side of the fan arrangement 23 rests on a bottom side of the tumble dryer 1. To direct the air flow from the fan 39 towards the inlet of the evaporator 17 via the air flow duct 33, a rotation axis 47 of the radial fan 39 may be arranged with an inclination ($\alpha$) of 0-25°, preferably between 5-15° from a vertical direction. In the embodiment shown in FIG. 4, the axis 47 of the radial fan 39 is arranged with an inclination ($\alpha$) of 7° from a vertical position. The axis is thus tilted slightly forwards to raise the air stream such that it hits the evaporator.

It is possible to remove the fan arrangement 23 as one unit through a hatch 49 arranged in the front wall 9 of the tumble dryer 1 (cf FIG. 1), which facilitates service, repairs or replacement of the radial fan 39 and/or its motor 41.

Figure 5:
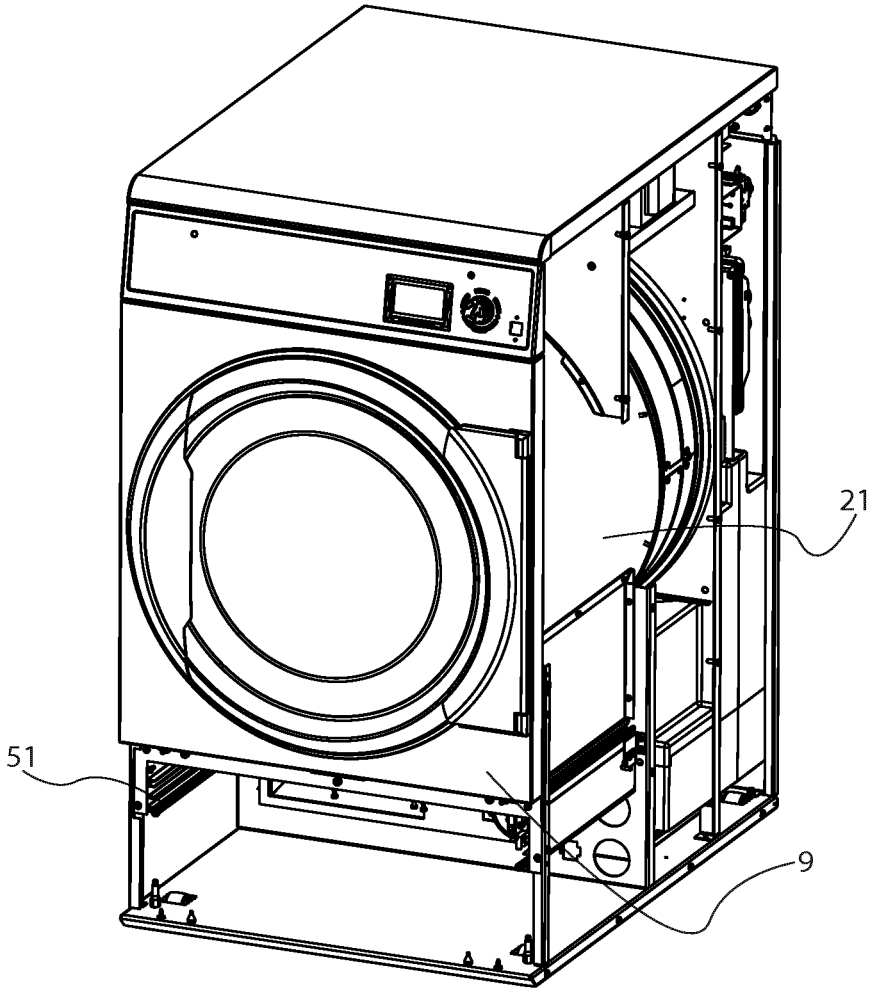
FIG. 5 is an isometric view of a tumble dryer with the fan arrangement and the particle filter(s) removed.

The lateral sides of the funnel shaped interface 45 can be inserted into grooves 51 arranged in respective sidewalls of the tumble dryer 1 as seen in FIG. 5 to provide a stiff connection between the casing 3 and the fan arrangement 23. The fan arrangement 23 is thus freely suspended at its upper part 23*a* and may rests against the bottom wall or floor of the dryer at its lower part 23*b* and may optionally be held in place by the hatch 49 in the front wall 9. Thus, the fan arrangement 23 can be removed from the tumble dryer 1 in a simple way that does not require any tools, simply opening the hatch 49 and pulling the fan arrangement 23 out.

The particle separation filter(s) 29 may also be inserted in grooves 51 arranged in respective sidewalls of the tumble dryer 1 just above the funnel shaped interface 45 and can be easily removed for cleaning or replacement.

The invention has mainly been described above with reference to a few embodiments. However, as is readily appreciated by a person skilled in the art, other embodiments than the ones disclosed above are equally possible within the scope of the invention, as defined by the appended patent claims.

For example, the tumble dryer may be an exhaust air dryer or condensing dryer instead of a heat pump dryer as shown in the embodiments.

In the claims, the word "comprising" does not exclude other elements or steps, and the indefinite article "a" or "an" does not exclude a plurality.

The invention claimed is:

1. A tumble dryer comprising:

a rotatable drying drum adapted to receive laundry to be dried, said drum comprising a cylindric outer periphery provided with a plurality of openings;

at least one particle separation filter arranged below the drying drum, said filter having a width corresponding to at least 50% of a cylindrical diameter of the drum;

a fan and a funnel shaped interface adapted for formation of a tapering transmission channel between the at least one filter and the fan, wherein the fan is surrounded by a plastic shell comprising the funnel shaped interface, wherein the funnel shaped interface has an inlet disposed directly adjacent to the at least one filter; and a heat pump system that comprises an evaporator, wherein the fan is arranged upstream of the evaporator, said fan being a radial fan having an axis arranged with an inclination of 0-25° from a vertical direction, such that an air stream that is introduced into the drum leaves the drum through the outer periphery thereof, is led through the at least one filter, is collected by the funnel shaped interface and is directed towards a rear part of the tumble dryer by the fan.

2. The tumble dryer according to claim 1, wherein the axis of the fan is arranged with an inclination of 5-15° from the vertical direction.

3. The tumble dryer according to claim 1, wherein the fan comprises a motor and is surrounded by the plastic shell comprising the funnel shaped interface, forming a fan arrangement.

4. The tumble dryer according to claim 3, wherein the fan arrangement is separably attached to the tumble dryer and removable as one unit through a front side of the tumble dryer.

5. The tumble dryer according to claim 3, wherein the fan arrangement is attached to the tumble dryer through a stiff connection.

6. The tumble dryer according to claim 3, wherein the fan arrangement is insertable in grooves arranged in respective sidewalls of the tumble dryer and is held in place by a hatch in a front wall of the tumble dryer.

7. The tumble dryer according to claim 3, wherein the fan arrangement rests against a bottom side, inside the tumble dryer.

8. The tumble dryer according to claim 1, wherein the fan comprises a motor, and the heat pump system further comprises a compressor, a condenser, and an expansion valve.

9. The tumble dryer according claim 8, wherein the heat pump system and the fan arrangement are arranged in a L-shaped configuration behind the drum, along the rear part of tumble dryer and below the drum.

10. The tumble dryer according to claim 1, wherein said at least one particle separation filter has a width corresponding to 80-100% of the cylindrical diameter of the drum.

11. The tumble dryer according to claim 1 wherein the at least one particle separation filter is a filter adapted to remove 80% or more of particles with sizes down to 4 μm.

12. The tumble dryer according to claim 1, wherein rotation of drum is powered by a motor, said motor being arranged on top of the drum.

13. The tumble dryer according to claim 1, wherein a size of the funnel shaped interface corresponds to a size of the at least one filter.

* * * * *